US005746097A

United States Patent [19]

McCann

[11] Patent Number: 5,746,097

[45] Date of Patent: May 5, 1998

[54] WRENCH HAVING A SPRING BIASED JAW

[76] Inventor: Frank McCann, 121, Yung Ho Road, Ta Ya Hsiang, Taichung Hsien, Taiwan

[21] Appl. No.: 802,867

[22] Filed: Feb. 19, 1997

[51] Int. Cl.[6] ..... B25B 13/28

[52] U.S. Cl. ..... 81/99; 81/97; 81/98; 81/126

[58] Field of Search ..... 81/99, 97, 98, 81/126

[56] References Cited

U.S. PATENT DOCUMENTS

| | | | |
|---|---|---|---|
| 1,635,930 | 7/1927 | Forsdahl | 81/99 |
| 1,672,804 | 6/1928 | Conrad | 81/99 |
| 2,559,974 | 7/1951 | Kunz | 81/99 |
| 2,655,064 | 10/1953 | Simon et al. | 81/99 |
| 4,651,597 | 3/1987 | Yang | 81/99 |

*Primary Examiner*—James G. Smith
*Assistant Examiner*—Lee Wilson
*Attorney, Agent, or Firm*—Charles E. Baxley

[57] ABSTRACT

A wrench for driving a fastener includes a fixed jaw formed on one end of a handle. A pivotal jaw is pivotally coupled to the handle at a pivot axle. A knob is slidably engaged on the handle. A resilient blade pivotally couples the knob to the pivotal jaw for allowing the knob to move the pivotal jaw toward the fixed jaw when the knob is moved toward the pivotal jaw. The handle includes a slot, the knob includes a projection extended inward of the slot for engaging with a spring which may bias the knob toward the pivotal jaw.

2 Claims, 4 Drawing Sheets

WRENCH HAVING A SPRING BIASED JAW

BACKGROUND OF THE INVENTION

1. Field of the Invention

The present invention relates to a wrench, and more particularly to a wrench having a spring biased pivotal jaw.

2. Description of the Prior Art

A typical wrench is shown in FIG. 5 and includes a handle 10 having a jaw 12 pivotally coupled to one end of the handle 10 at a pivot axle 14. The handle 10 includes a fixed jaw 11 for acting with the pivotal jaw 12 and for defining an opening 13 and for engaging with and for driving a fastener. However, the pivotal jaw 12 may rotate freely about the pivot axle 14 such that the pivotal jaw 12 may be easily damaged and may not suitably engage with the fastener some times.

The present invention has arisen to mitigate and/or obviate the afore-described disadvantages of the conventional wrenches.

SUMMARY OF THE INVENTION

The primary objective of the present invention is to provide a wrench having a spring biased pivotal jaw for facilitating the engagement of the pivotal jaw to engage with the fastener.

In accordance with one aspect of the invention, there is provided a wrench for driving a fastener, the wrench comprises a handle including a first end having a fixed jaw provided in the first end, a pivotal jaw pivotally coupled to the first end of the handle at a pivot axle, and means for rotating the pivotal jaw and for moving the pivotal jaw toward the fixed jaw and for allowing the pivotal jaw and the fixed jaw to solidly engage with the fastener.

The rotating means includes a knob slidably engaged on the handle, means coupling the knob to the pivotal jaw, and means for biasing the knob toward the pivotal jaw and for moving the pivotal jaw toward the fixed jaw.

The pivotal jaw includes a pin, the knob includes a notch, the coupling means includes a resilient blade having a first end pivotally coupled to the pivotal jaw at the pin and having a second end secured to the notch of the knob, for allowing the knob to move the pivotal jaw toward the fixed jaw. The handle includes a slot, the knob includes a projection extended inward of the slot for engaging with the biasing means.

Further objectives and advantages of the present invention will become apparent from a careful reading of a detailed description provided hereinbelow with appropriate reference to accompanying drawings.

DETAILED DESCRIPTION OF THE PREFERRED EMBODIMENT

Figure 1:
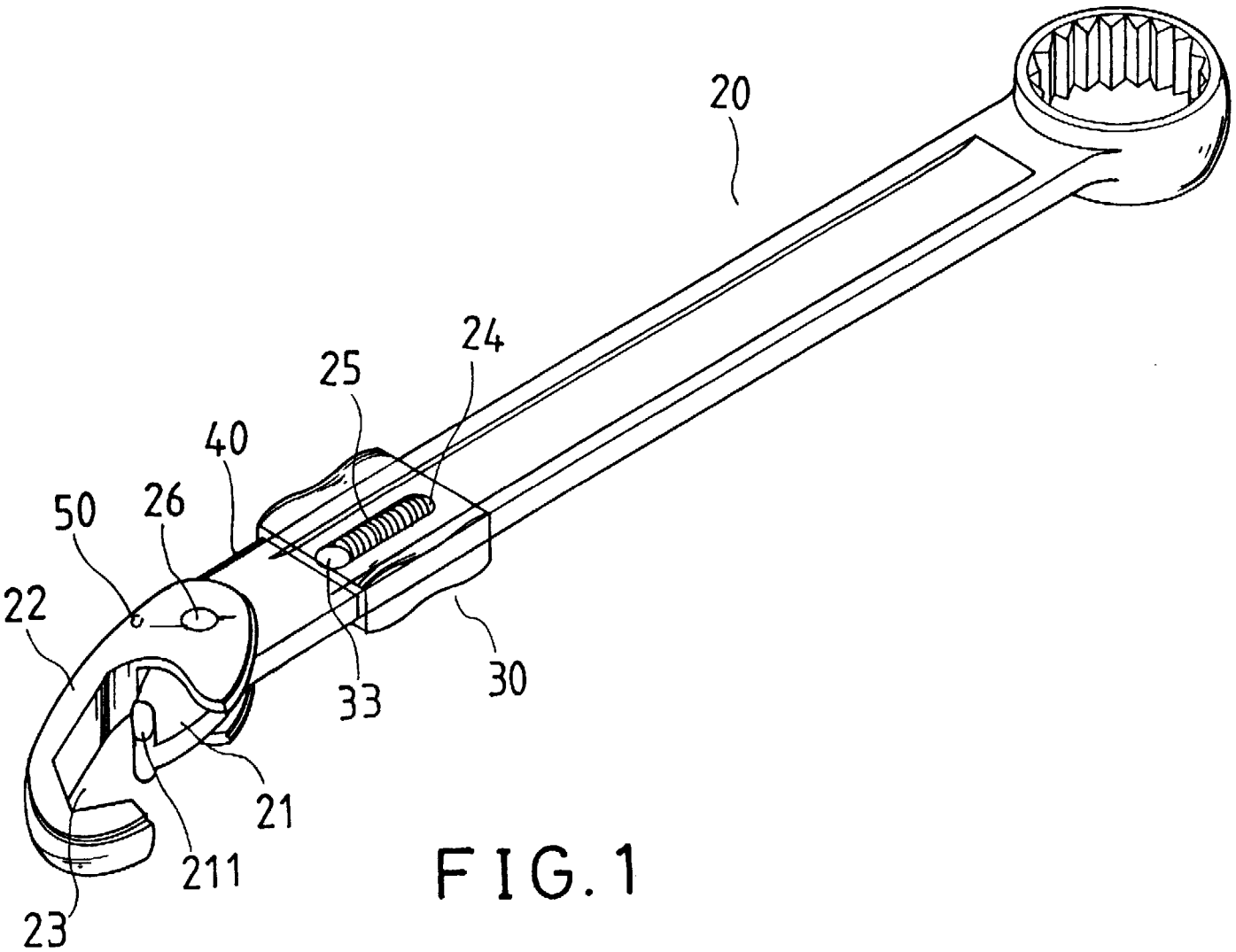
FIG. 1 is a perspective view of a wrench in accordance with the present invention.
Figure 2:
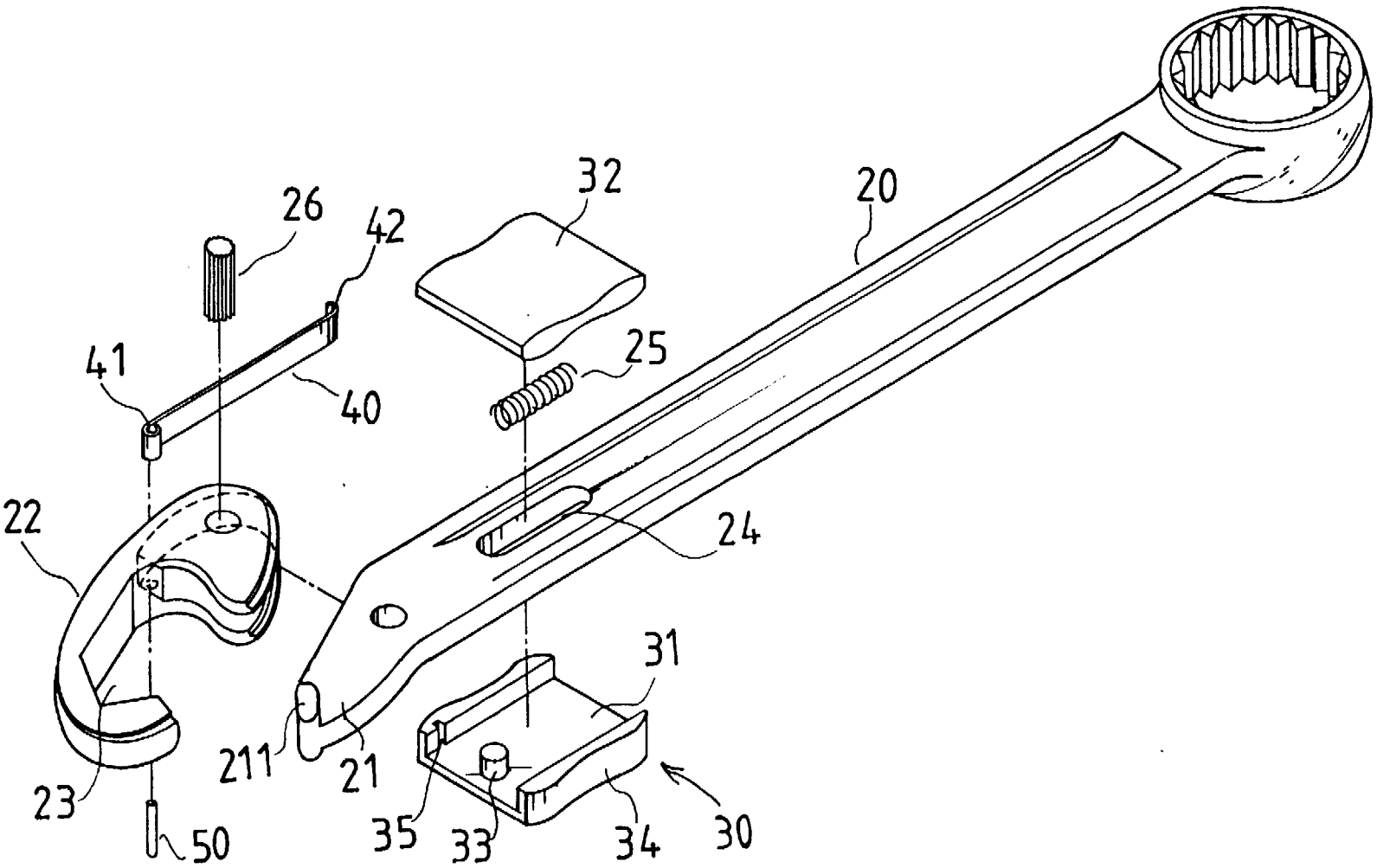
FIG. 2 is an exploded view of the wrench.
Figure 3:
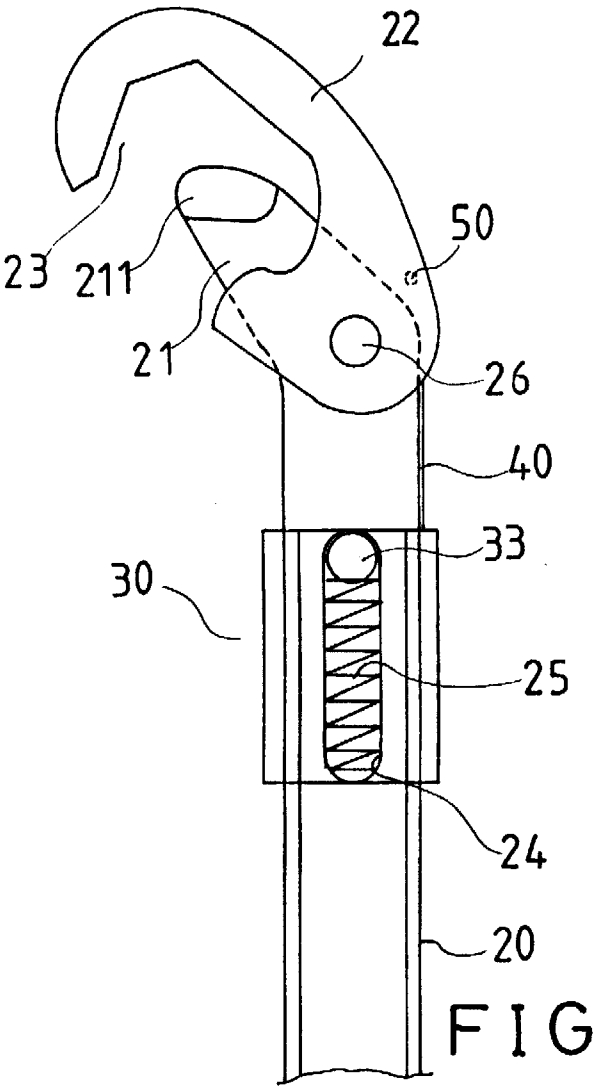
Figure 5:
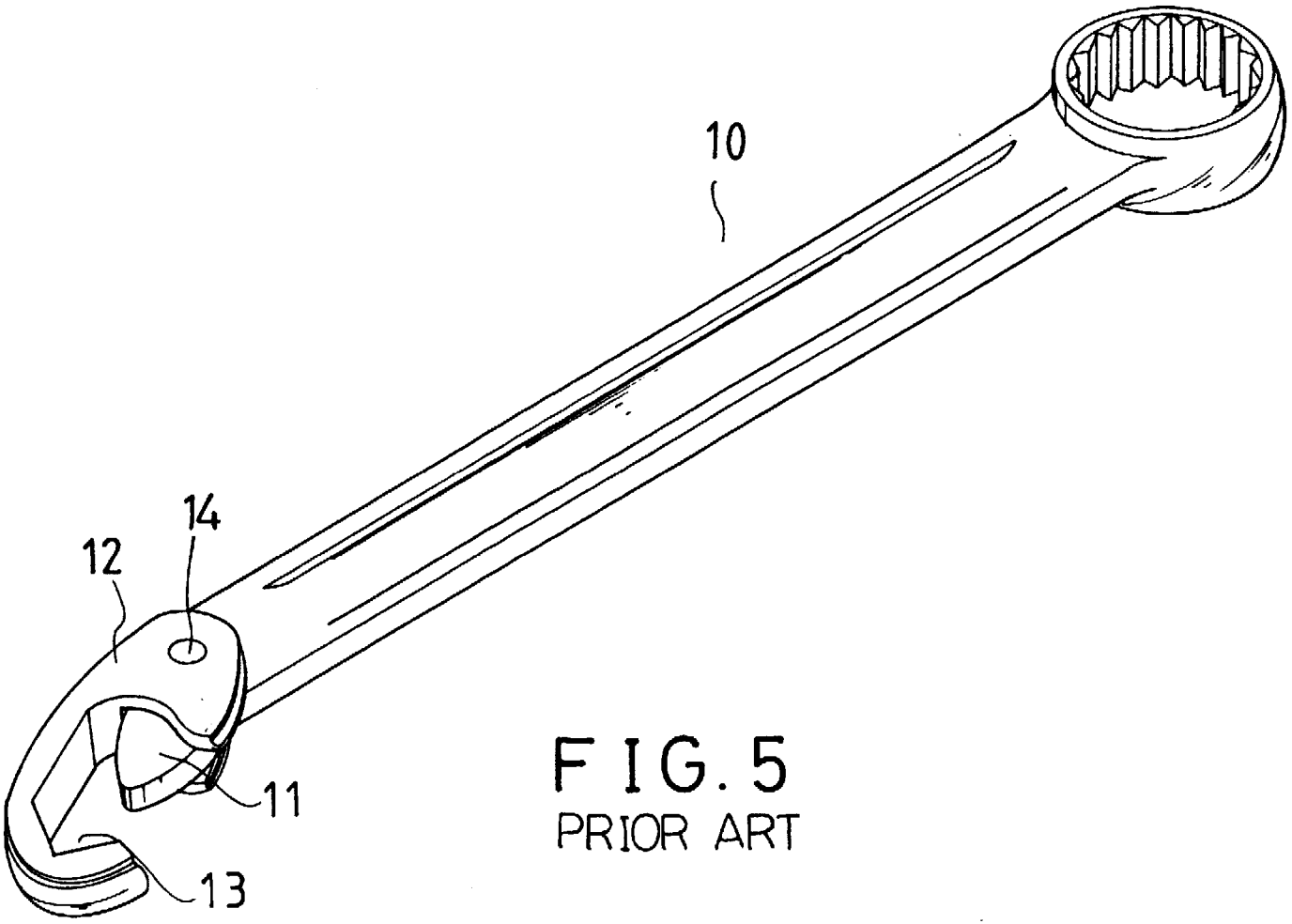
FIG. 5 PRIOR ART
FIG. 5 is a perspective view of a typical wrench.

Referring to FIGS. 1 to 3, a wrench in accordance with the present invention comprises a handle 20 including a fixed jaw 21 provided in one end and including a slot 24 formed in the handle 20 for receiving a spring 25. A pivotal jaw 22 is pivotally coupled to the one end of the handle 20 at a pivot axle 26. The pivotal jaw 22 and the fixed jaw 21 define an opening 23 for engaging with a fastener to be driven. The fixed jaw 21 includes an enlarged member 211 for facilitating the engagement with the fastener. A pin 50 is secured to the middle portion of the pivotal jaw 22.

A knob 30 includes a base 31 slidably engaged on the handle 20 and a cap 32 secured to the base 31 for slidably securing the knob 30 to the handle 20 and for allowing the knob 30 to be moved along the handle 20. The knob 30 includes a projection 33 extended inward of the slot 24 for engaging with the spring 25 and for allowing the spring 25 to bias the knob 30 toward the jaws 21, 22. It is preferable that the knob 30 includes a curved and smooth outer peripheral surface 34 for facilitating the movement of the knob 30. The knob 30 includes a notch 35 formed therein. A resilient blade 40 includes one end 41 pivotally coupled to the pivotal jaw 22 at the pin 50 and includes the other end 42 secured in the notch 35 of the knob 30 for allowing the knob 30 to rotate the pivotal jaw 22 and for facilitating the engagement of the jaws 21, 22 with the fastener to be driven.

Figure 4:
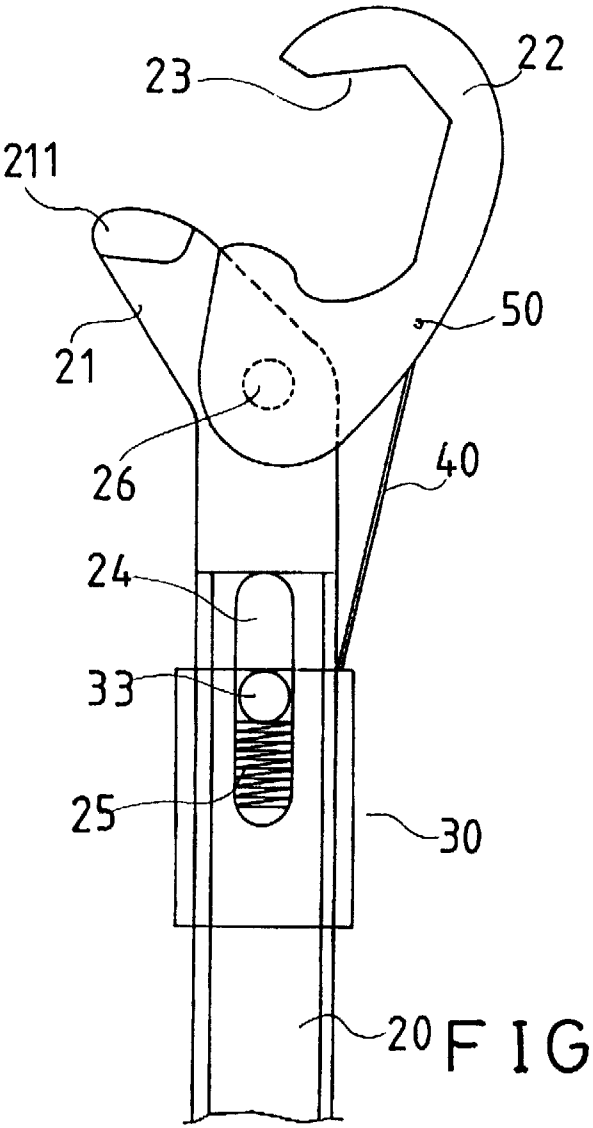
FIGS. 3 and 4 are partial plane views illustrating the operation of the wrench.

In operation, as shown in FIGS. 3 and 4, the pivotal jaw 22 may be rotated away from the fixed jaw 21 by the resilient blade 40 when the knob 30 is moved away from the jaws 21, 22 such that the pivotal jaw 22 may be easily engaged with a fastener to be driven. When the knob 30 is released, the pivotal jaw 22 may be rotated toward the fixed jaw 21 by the resilient blade 40 when the knob 30 is moved toward the jaws 21, 22 by the spring 25, such that the jaws 21, 22 may solidly engage with the fastener and such that the fastener may be suitably operated.

Accordingly, the wrench includes a spring biased pivotal jaw for solidly engaging with the fastener and for suitably driving the fastener.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench for driving a fastener, said wrench comprising:

a handle including a first end having a fixed jaw provided in said first end, a pivotal jaw pivotally coupled to said first end of said handle at a pivot axle, and means for rotating said pivotal jaw and for moving said pivotal jaw toward said fixed jaw and for allowing said pivotal jaw and said fixed jaw to solidly engage with the fastener, said rotating means including a knob slidably engaged on said handle, means for coupling said knob to said pivotal jaw, and means for biasing said knob toward said pivotal jaw and for moving said pivotal jaw toward said fixed jaw, said pivotal jaw including a pin, said knob including a notch, said coupling means including a resilient blade having a first end pivotally coupled to said pivotal jaw at said pin and having a second end secured to said notch of said knob, for allowing said knob to move said pivotal jaw toward said fixed jaw.

2. A wrench for driving a fastener, said wrench comprising:

a handle including a first end having a fixed jaw provided in said first end, said handle including a slot, a pivotal jaw pivotally coupled to said first end of said handle at a pivot axle, and means for rotating said pivotal jaw and for moving said pivotal jaw toward said fixed jaw and for allowing said pivotal jaw and said fixed jaw to solidly engage with the fasteners, said rotating means including a knob slidably engaged on said handle means for coupling said knob to said pivotal jaw, and means for biasing said knob toward said pivotal jaw and for moving said pivotal jaw toward said fixed jaw, said knob including a projection extended inward of said slot for engaging with said biasing means.

* * * * *